US006810958B2

(12) United States Patent
Szarka et al.

(10) Patent No.: US 6,810,958 B2
(45) Date of Patent: Nov. 2, 2004

(54) CIRCULATING CEMENTING COLLAR AND METHOD

(75) Inventors: David D. Szarka, Duncan, OK (US); Henry E. Rogers, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 63 days.

(21) Appl. No.: 10/026,736

(22) Filed: Dec. 20, 2001

(65) Prior Publication Data

US 2003/0116320 A1 Jun. 26, 2003

(51) Int. Cl.[7] ..... E21B 34/06
(52) U.S. Cl. ..... 166/285; 166/242.8; 166/327
(58) Field of Search ..... 166/285, 326, 166/321, 325, 327, 242.8, 166

(56) References Cited

U.S. PATENT DOCUMENTS

| | | | | | |
|---|---|---|---|---|---|
| 2,155,609 | A | | 4/1939 | McClendon et al. | 166/1 |
| 2,602,510 | A | | 7/1952 | Baker | 166/1 |
| 2,741,314 | A | | 4/1956 | Deters | 166/195 |
| 2,791,279 | A | | 5/1957 | Clark, Jr. | 166/225 |
| 2,846,015 | A | | 8/1958 | Pittman | 166/224 |
| 2,847,074 | A | | 8/1958 | Maly et al. | 166/224 |
| 2,928,470 | A | | 3/1960 | Baker | 166/154 |
| 2,947,363 | A | | 8/1960 | Sackett et al. | 166/224 |
| 2,998,075 | A | | 8/1961 | Clark, Jr. | 166/194 |
| 3,338,311 | A | | 8/1967 | Conrad | 166/154 |
| 3,385,370 | A | | 5/1968 | Knox et al. | 166/225 |
| 3,419,081 | A | | 12/1968 | Nelson | 166/225 |
| 3,527,297 | A | | 9/1970 | Todd | 166/154 |
| 3,559,734 | A | * | 2/1971 | Pitts | 166/320 |
| 3,633,671 | A | | 1/1972 | Nelson | 166/224 |
| 3,957,114 | A | | 5/1976 | Streich | 166/285 |
| 4,067,358 | A | | 1/1978 | Streich | 137/624.13 |
| 4,083,409 | A | | 4/1978 | Barrington | 166/320 |
| 4,086,935 | A | * | 5/1978 | Raulins et al. | 137/522 |
| 4,103,739 | A | | 8/1978 | Hall | 166/105 |
| 4,105,069 | A | | 8/1978 | Baker | 166/51 |
| 4,162,691 | A | | 7/1979 | Perkins | 137/613 |
| 4,423,782 | A | * | 1/1984 | Bowyer | 166/321 |
| 4,590,998 | A | | 5/1986 | Hopper | 166/331 |
| 4,662,453 | A | | 5/1987 | Brisco | 166/387 |
| 4,664,192 | A | | 5/1987 | Hogarth | 166/291 |
| 4,694,903 | A | * | 9/1987 | Ringgenberg | 166/250.08 |

(List continued on next page.)

FOREIGN PATENT DOCUMENTS

| | | | |
|---|---|---|---|
| GB | 2 309 470 A | 7/1997 | E21B/21/10 |
| WO | WO 98/48143 | 10/1998 | E21B/33/13 |
| WO | WO 01/69037 A1 | 9/2001 | E21B/34/14 |

OTHER PUBLICATIONS

Halliburton Sales and Service Catalog; 1958; pp. 2217–2223.

(List continued on next page.)

*Primary Examiner*—David Bagnell
*Assistant Examiner*—Daniel P Stephenson
(74) *Attorney, Agent, or Firm*—John W. Wustenberg; Craig W. Roddy; Carlos A. Torres

(57) ABSTRACT

An apparatus and method for cementing a casing string in a wellbore. A self-filling tubular cementing collar connected to the lower end of a casing string is provided with one-way flow valving that allows well fluid to enter and self-fill the casing string as it is lowered into the wellbore and automatically prohibits reverse fluid flow from the collar when washing or cementing during forward circulation through the collar. The one-way valving is carried by an axially movable support that can be shifted by a cementing plug moved by pump pressure to permanently seal the entry flow passage after the casing sting is properly positioned in the wellbore.

32 Claims, 4 Drawing Sheets

U.S. PATENT DOCUMENTS

| | | | | |
|---|---|---|---|---|
| 4,880,058 | A | 11/1989 | Lindsey et al. | 166/289 |
| 5,040,606 | A | 8/1991 | Hopper | 166/332 |
| 5,178,219 | A | 1/1993 | Streich et al. | 166/289 |
| 5,234,052 | A | 8/1993 | Coone et al. | 166/155 |
| 5,297,629 | A | 3/1994 | Barrington et al. | 166/297 |
| 5,472,053 | A | * 12/1995 | Sullaway et al. | 166/327 |
| 5,540,280 | A | 7/1996 | Schultz et al. | 166/250.07 |
| 5,597,016 | A | 1/1997 | Manke et al. | 138/46 |
| 5,641,021 | A | 6/1997 | Murray et al. | 166/291 |
| 5,735,348 | A | 4/1998 | Hawkins, III | 166/285 |
| 5,909,771 | A | 6/1999 | Giroux et al. | 166/120 |
| 5,918,673 | A | 7/1999 | Hawkins et al. | 166/285 |
| 5,960,881 | A | 10/1999 | Allamon et al. | 166/291 |
| 5,971,079 | A | 10/1999 | Mullins | 166/387 |
| 6,082,459 | A | 7/2000 | Rogers | 166/334.1 |
| 6,098,710 | A | 8/2000 | Knudsen et al. | 166/285 |
| 6,173,777 | B1 | 1/2001 | Mullins | 166/285 |
| 6,182,766 | B1 | 2/2001 | Rogers et al. | 166/386 |
| 6,244,342 | B1 | * 6/2001 | Sullaway et al. | 166/285 |
| 6,279,654 | B1 | 8/2001 | Mosing et al. | 166/285 |
| 6,318,472 | B1 | 11/2001 | Rogers et al. | 166/382 |

OTHER PUBLICATIONS

Halliburton Sales and Service Catalog; 1960; pp. 2341–2347.

Guiberson–Ava Brochure entitled: Retrievable Packer Production & Completion Accessories (p. 37).

Allamon & Associates brochure entitles "EZ–GO Surge Reduction System" (undated but admitted to be prior art).

* cited by examiner

CIRCULATING CEMENTING COLLAR AND METHOD

BACKGROUND OF THE INVENTION

1. Field of the Invention

The present invention relates generally to the field of cementing well pipes into a well. More specifically, the present invention relates to methods and apparatuses for cementing a string of well pipe in a wellbore with a self-filling cementing collar.

2. Setting of the Invention

U.S. Pat. No. 5,641,021, assigned to the Assignee of the present invention, describes a well casing fill apparatus and methods for filling a casing string with wellbore fluid while running a string into a wellbore and cementing the casing into the wellbore. This patented prior art well casing fill apparatus is comprised of a tubular housing having a wellbore fluid fill port extending through a housing wall and a closing sleeve slidably disposed in the tubular housing movable axially between an upper position in which the fluid fill port is open and a lower position in which the fill port is closed by the sliding sleeve. A landing seat on the closing sleeve receives a cementing plug to slide the closing sleeve to the closed position. A one-way check valve in a casing shoe at the foot of the fill apparatus prevents fluid from entering the casing but opens to allow cement in the casing to exit from the casing shoe bottom.

The patented prior art device is capable of permitting the casing string to self-fill quickly, while minimizing hydraulic forces generated on subterranean strata as a result of running the casing string into a fluid filled wellbore. If, however, it becomes necessary to circulate through the end of the casing string shoe, as may be required for example to wash the casing string past an obstruction, the closing sleeve must be shifted down to close the fill ports so that the circulating fluid will exit from the bottom of the casing. Once the closing sleeve has been shifted to the closed position, the automatic fill function of the fill apparatus becomes permanently disabled. Subsequent lowering of the casing into the wellbore requires that the casing string be lowered very slowly to prevent the creation of hydraulic ram forces that can break down formations below the casing. The disabling of the self-fill apparatus may also require that fill fluid be added from the well surface as the casing string is lowered, which further slows and complicates the casing running process.

SUMMARY OF THE INVENTION

The circulating cementing collar of the present invention provides self-filling, one-way flow of well fluids into a casing string from a fluid filled wellbore while the casing string is being lowered into the wellbore and automatically permits forward circulation of fluid through the end of the casing when desired without disabling the self-fill function. The cementing collar of the present invention may be cycled between its self-filling function and its forward circulation function as often as required during placement of the casing in the wellbore.

In one form of the invention, an axially movable sleeve carried within the cementing collar is equipped with one-way flow passages that permit the casing string to self-fill with well fluids that enter the casing string from fill passages extending through the wall of the collar. The one-way flow passages are provided with valving that prevents a reverse flow of fluids from the casing through the fill passages. In operation, the one-way flow passages remain open as the casing is being lowered into the fluid filled wellbore, thereby permitting the well fluid to automatically fill the casing while minimizing the imposition of hydraulic ramming forces against the subsurface formation. If forward circulation through the casing becomes necessary, well fluid may be pumped from the surface through the casing, closing the one-way valving of the fill passages and forcing the fluid to exit the end of the casing. Fluid exiting the lowermost end of the casing string is effectively applied directly against any bridging material or other obstruction that initiated the requirement for forward circulation.

The self-filling action is permanently disabled when the cement slurry is pumped into the casing string to prevent back-flow of the cement into the casing through the fill passages.

From the foregoing, it will be appreciated that a primary object of the present invention is to provide a self-filling cementing device that permits conversion from a self-filling function in which well fluids are automatically admitted into the casing string to a forward circulation function in which well fluids are circulated from the bottom of the casing string while maintaining the ability to automatically revert to the self-filling function following termination of the forward circulation function.

Another object the present invention is to provide a low-cost cementing collar that can be fabricated from inexpensive, simply manufactured components and that permits self-filling of a well casing while maintaining the capability at anytime during the placement of the casing in the wellbore to initiate forward circulation through the cementing collar as required to wash past an obstruction in the wellbore and thereafter revert to a self-filling function as the casing is lowered further into the wellbore.

Yet another object of the present invention is to provide a cementing device that permits conversion between self-filling of the casing string and forward circulation of fluids through the string as often as required while lowering the casing string into the wellbore and that further permits the self-filling function to be remotely terminated when the casing has been positioned at the desired location within the wellbore to prevent flow back of fluid through the self-fill passages.

An important object of the present invention is to provide one-way flow valving in a subsurface circulating cement collar with a design that employs low cost, easy to fabricate components and in which the components effect one-way flow control without the requirement for precise dimensional tolerances or special materials.

The foregoing features, advantages and objects of the present invention will be more fully understood and better appreciated by reference to the following drawings, specification and claims.

DESCRIPTION OF THE ILLUSTRATED EMBODIMENTS

Figure 1:
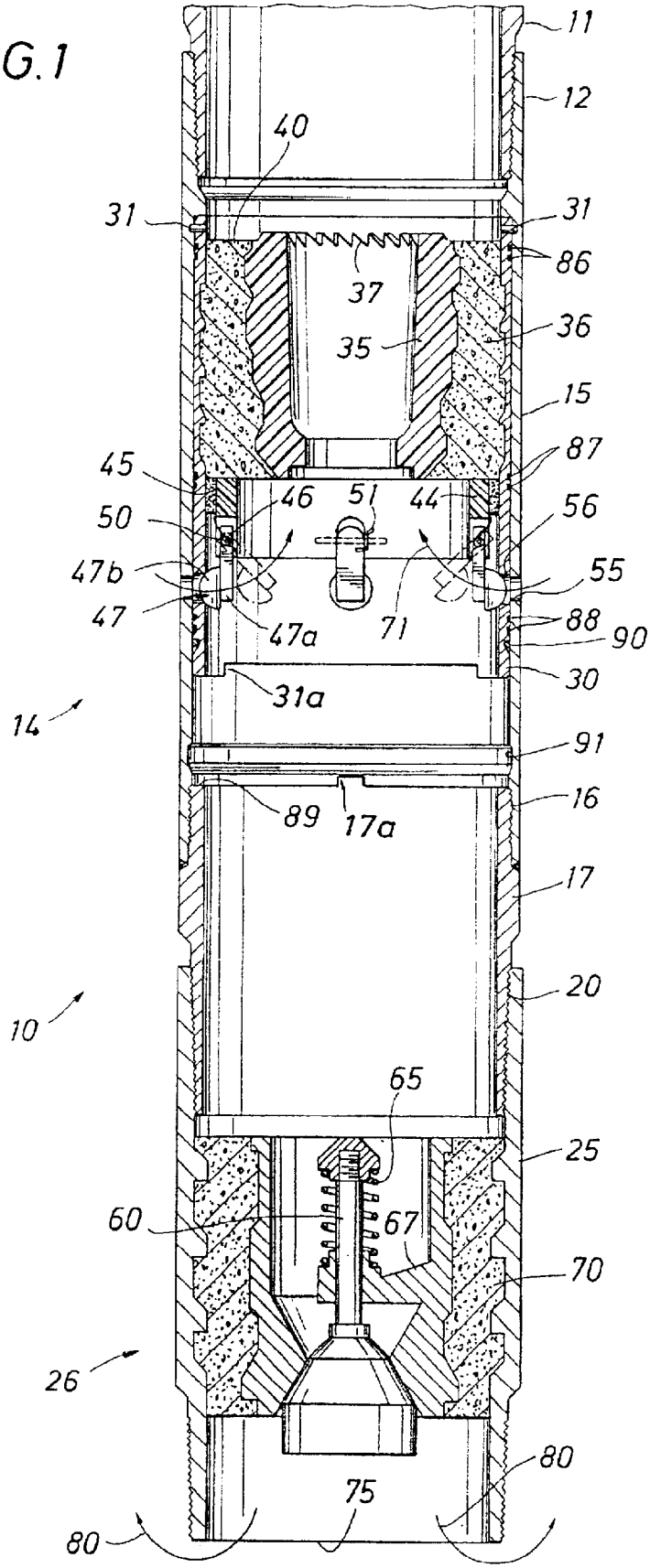
FIG. 1 is a vertical half-sectional view of a cementing collar of the present invention configured to selectively permit or prevent drilling fluid passage through the cementing collar wall.

A self-filling circulating cementing collar of the present invention is indicated generally at 10 in FIG. 1. The collar 10 is secured at the base of a liner or casing string 11 by threads 12. The cementing collar 10 includes a self-fill device 14 contained within a tubular valve housing 15. The self-fill device 14 is connected by threads 16 to a tubular landing section 17 that, in turn, is secured by threads 20 to a tubular valve housing 25. A float valve, indicated generally at 26, is provided in the form of a collar forming the valve housing 25, as illustrated in FIG. 1, or may take the form of a casing shoe or other configuration connected to the lower end of the casing string 11. The valve housing 15, tubular landing section 17 and the valve housing 25 are preferably constructed of steel or other suitable metal alloy. In some applications, where pressure and structural limitations permit, it may be desirable to construct these components of a synthetic or composite material.

A tubular, axially movable sliding support sleeve 30 is carried coaxially within the valve housing 15. The support sleeve 30 is temporarily secured against axial movement relative to the valve housing 15 by shear pins 31 that extend between the support and the valve housing. A central tubular plug retainer 35 is mounted by cement or epoxy 36 coaxially within the upper end of the support sleeve 30. The plug retainer 35 is preferably constructed of plastic, a composite material or other suitable easily drillable material. The upper end surfaces of the mounting material 36 and plug retainer 35 function as a seat 40 that is adapted to receive a cementing plug, as will hereinafter be described. Optional anti-rotation teeth 37 at the top of the plug retainer 35 are used to prevent rotation of the cementing plug as it is being drilled out following completion of the cementing operation. In a preferred form of the invention, the support sleeve 30 is constructed of steel or other suitable metal. In some applications, where well conditions permit, the support sleeve may be constructed of a composite or synthetic material. The shear pins 31 are preferably constructed of a material that predictably severs when exposed to a predetermined force.

The self-filling device 14 is held in place with a securing mechanism, such as a suitable adhesive or cementing material 45, that secures an annular valve mount ring 44 at the base of the cement 36. It will be appreciated that other securing mechanisms such as set screws, pins and other mechanical securing devices may be used to hold the mount ring 44 within the sleeve support 30. The mount ring 44 is provided with longitudinal slots 46 within which are pivotally mounted flapper valve closure elements 47. The mount ring 44 is preferably constructed of easily drillable composite material, plastic or other synthetic material.

Each of the flapper valve elements is comprised of an arm section 47*a* and a hemispherical closure member 47*b*. Each flapper element pivots about a pivot pin 50 spanning a longitudinal slot 46 formed in the wall of the mount ring 44. A coil spring 51 carried about the hinge pin 50 urges each flapper valve closure element 47 toward its closed position. In most applications, the coil spring 51 is not essential to the proper functioning of the cementing collar and may usually be omitted. The spring is desirable, however, when the cementing collar orientation or other conditions may restrict the normal flow or gravity induced movement of the flapper element to its closed position. The pivot pin 50 is constructed of steel or other suitable material. The relatively small coil spring 51 may be constructed of spring steel or other suitable resilient material.

Radial openings 55 extend through the valve housing wall 15 and register with larger diameter radial openings 56 extending through the wall of the movable sliding sleeve support 30. Constructing each of the openings 56 with a larger diameter than that of the openings 55 simplifies the alignment of the openings and reduces the requirement for precision manufacturing of the components of the cementing collar. The hemispherical shape of the closure member 47*b* allows the member to check and seal against a non circular, concave sealing surface formed by the intersection of the cylindrical internal surface of the sliding sleeve 30 and the cylindrical radial opening 56.

The closure member 47*b* may be constructed of a rubber or phenolic sphere of suitable size cut into hemispheres. Since complete sealing is not required between the closure member 47*b* and the opening 56 through the wall of the sleeve support 30, relatively rigid material may be used in the construction of the closure member 47*b* without need for additional elastomeric coatings or seal surfaces on the closure member or the opening through the sleeve support. For similar reasons, the closure member 47*b* and the seat formed in the wall of the support sleeve need not be precisely machined or otherwise manufactured to close tolerances. The arm section 47*a* of the flapper element 47 may be constructed from any suitable flat stock material and secured to the hemispherical section 47*b* by any suitable means. While not necessarily preferred, it will be appreciated that the flapper section comprised of the arm 47*a* and hemispherical section 47*b* may be formed by more expensive procedures such as by a one-piece casting, molding or by machining or other suitable process.

The flapper valve closure element 47, in the position of the solid line illustration of FIG. 1, closes the communicating radial openings 55 and 56 to fluid flow in a direction from the inside of the cementing collar to the area external to the cementing collar. When the opening force of the pressure externally of the cementing collar is greater than the combined closing forces of the internal collar pressure, the fluid flow and the spring force, the flapper valve closure elements open to permit the fluid in the wellbore to enter the cementing collar to self-fill the casing string. The open position of the closure element is depicted in the dashed line in FIG. 1.

The float collar 26, which is conventional, is equipped with a poppet type valve in the form of a check valve closure element 60 that is biased to a closed position by a coil spring 65. A check valve mount 67 is held by cement 70 within the valve housing 25. The check valve closure 60 and the mount 67 are preferably constructed of a phenolic plastic or other suitable material. The spring 65 is preferably constructed of a drillable metal or composite material or other suitable resilient or elastomeric material. When the pressure within the cementing collar 10 is sufficiently greater than that within the surrounding wellbore, the pressure differential overcomes the spring bias and moves the valve element 60 away from its seat so that well fluids may be pumped out from the casing through the end of the cementing collar 10. Thus, in the event an obstruction is met in the wellbore below the float valve 26, fluid may be pumped into the casing string to circulate fluid around the very bottom 75 of the cementing collar along a path indicated by the arrows 80.

The float valve indicated generally by reference numeral 26 is conventional and may be replaced by other commonly used, well known prior art float valves. For example, the float valve element 60 may take the form of a valve using a caged low specific gravity ball to effect a back pressure valve. In this type valve, fluid is free to move longitudinally downwardly, but as the ball will float in virtually any well fluid heavier than fresh water, the ball "floats" back up against the ball seat in the top of the cage/float assembly to effect a back pressure valve. Float valve assemblies utilizing a flapper valve are also used in the industry.

Once the bridge or other obstruction has been washed away, pumping and forward circulation may be terminated and the casing string may be further lowered into the wellbore. During the lowering process, with the pumping terminated, the pressure within the cementing collar 10 becomes lower than that of the fluid in the surrounding wellbore. The resulting pressure differential overcomes the spring bias and internal hydrostatic pressure acting on the flapper valves 47, causing the flapper elements to swing away from the opening ports and allowing the drilling fluid to enter the cementing collar to reinitiate the self-fill of the casing string. The sequence of fill and forward circulation may be repeated as often as desired during the placement of the casing string in the wellbore.

Figure 2:
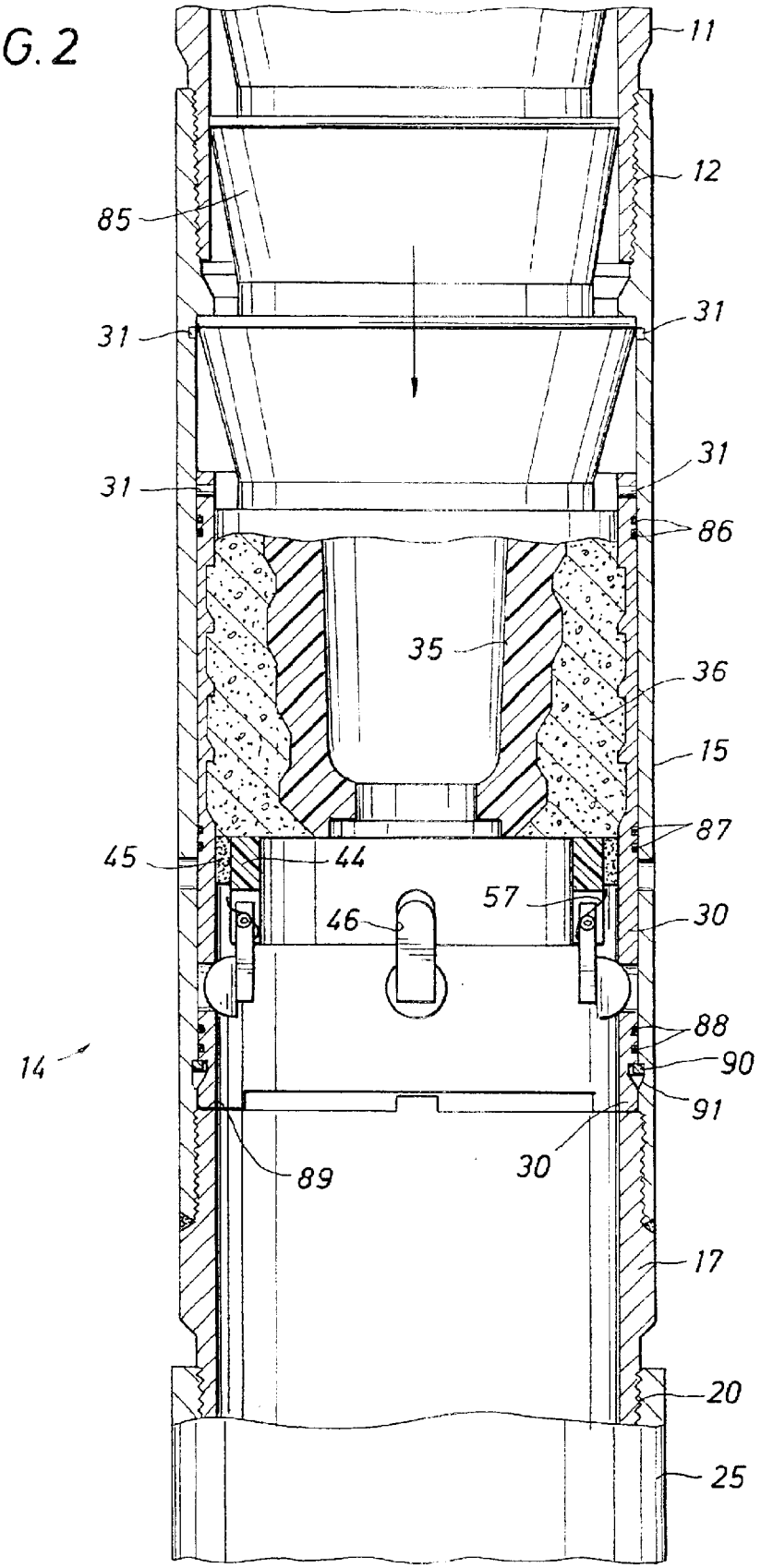
FIG. 2 is a vertical sectional view of the cementing collar of FIG. 1 illustrating a cementing plug shifting valving components of the cementing collar to a position permanently terminating the influx of drilling fluid through the cementing collar wall.

With joint reference to FIGS. 1 and 2, after properly positioning the casing in the wellbore, a first or "bottom" cementing plug 85 is freed for movement (if a remotely set plug) or inserted into the casing and a cement slurry (not illustrated) is pumped into the casing behind the plug. A volume of the cement slurry calculated to fill the annular space between the casing string and the wellbore is pumped into the casing. When the calculated volume of cement has been pumped, a second or "top" cementing plug (not illustrated) is released into the casing and a drilling fluid is pumped behind the second plug to displace the cement from the casing.

As best illustrated in FIG. 2, once the bottom cementing plug 85 reaches the seating surface 40 at the top of the support 30, the pressure exerted by the pumped fluid behind the plug exerts an axial force against the cementing plug 85 sufficient to sever the shear pins 31. The axial force exerted by the plug 85 against the support 30 drives the support axially down to the position illustrated in FIG. 2. Axially spaced, elastomeric O-ring seals 86, 87 and 88 form a pressure-tight sliding engagement between the support 30 and the surrounding valve housing 15 to maintain the pressure seal forcing the assembly to move down into the cementing collar.

When the axial movement of the support 30 shifts the cementing plug 85 and support 30 axially downwardly into the position illustrated in FIG. 2, the base of the support 30 engages a shoulder 89 formed at the upper end of the landing section 17. At this point, a snap ring 90 springs radially outwardly into an annular recess 91 in the internal wall of the valve housing 15 to prevent return upward axial movement of the sleeve support 30 and permanently deactivate the self-fill function. When the self-fill cementing collar is permanently deactivated, the support sleeve 30 may also be locked against rotation by any suitable means such as a spline slot 31*a* that engages and stops against a lug projection 17*a* to prevent rotation within the housing 15 to thereby facilitate drilling out the collar at completion of the cementing procedure.

Continued pump pressure applied from the surface after the support 30 is landed on the shoulder 89 forces a central opening (not illustrated) in the bottom plug 85 to open permitting the cement slurry to flow through the plug down through the bottom of the collar assembly and up into the wellbore surrounding the casing along a path indicated by the arrows 80. With the valving mechanism of the control collar 10 shifted into the permanently closed position, illustrated in FIG. 2, the cement slurry is forced to exit the bottom of the casing string and is prevented from re-entering the collar through the ports 55 and 56.

Figure 3:
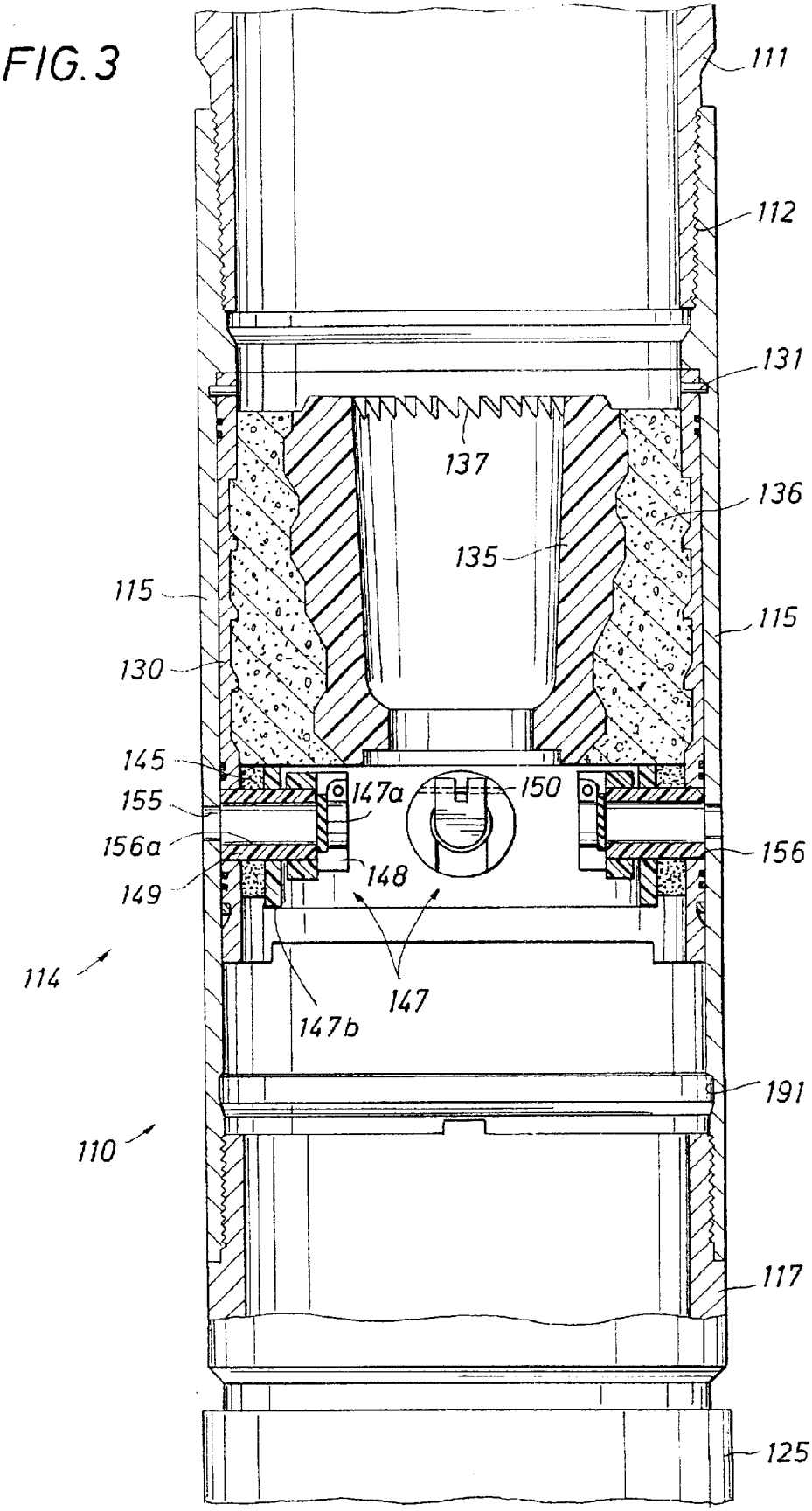
FIG. 3 is a vertical half-sectional view of a modified form of a cementing collar of the present invention illustrating a planar flapper check valve element used to terminate flow through the cementing collar wall.

FIG. 3 of the drawings illustrates a modified form of the invention indicated generally at 110 having multiple flapper valves, such as the valve indicated generally at 147. The illustration in FIG. 3 carries reference characters that are higher by 100 than the reference characters used for corresponding components illustrated in FIGS. 1 and 2. As with the form of the invention illustrated in FIGS. 1 and 2, the flapper valve components of the cementing collar 110 are constructed of inexpensive, easily obtained materials that can be efficiently manufactured and assembled. For example, the components may be manufactured from a combination of drillable tube and bar stock, or suitable plastic or phenolic materials.

Each of the flapper valves 147 is provided with a disk-shaped, planar flapper valve closure element 147*a*. Each flapper element 147*a* pivots about a pin 150 carried within a slot in an annular hinge mount secured about the internal radial end of a flow tube 149. The flow tubes 149 extend radially through a bore 156 in the wall of a sliding sleeve support 130 and through an opening formed in an annular support ring 147*b*. A central opening 156*a* extending through the flow tube 149 registers with a smaller opening 155 in a wall of a valve housing 115. An adhesive such as an epoxy or cement 145 is used to secure the support ring 147*b* to the internal surface of the valve support 130. As with the embodiments of the invention illustrated in FIGS. 1 and 2, the provision of a larger diameter for the flow tube opening 156*a* minimizes the need for precise placement of components in the fabrication of the cementing collar 110. The larger diameter of the flow tube 149 also prevents the tubes from being pumped through the openings 155 in the cementing collar wall when relatively high circulating pressures are required.

In operation, the cementing collar 110 functions in the manner described for the cementing collar 10 illustrated in FIGS. 1 and 2. The flapper valve elements 147*a* open and close as a result of the internal fluid flow and the pressure differential that exists between the inside and outside of the cementing collar 110. When forward circulation is initiated, the planar flapper element 147*a* conforms to the planar annular seat formed at the end of the flow tube 149 to substantially terminate any flow of fluid through the self-fill passages in a direction from inside the collar 110 to the area outside of the collar.

Figure 4:
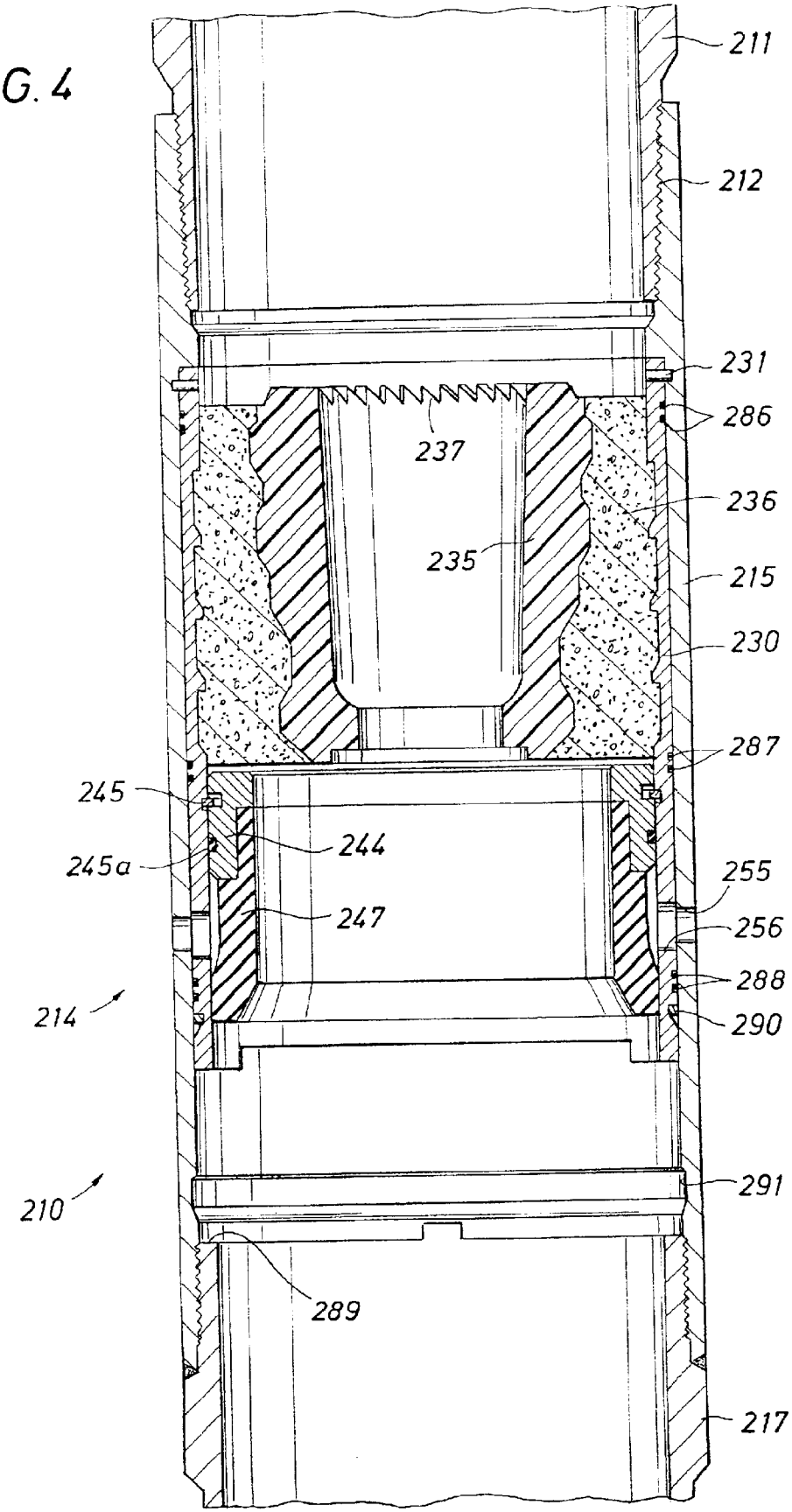
FIG. 4 is a vertical half-sectional view of a modified form of a segment of the valve of the present invention employing an annular elastomeric sleeve as a one-way valve element regulating the flow of drilling fluids through the cementing collar wall.

FIG. 4 of the drawings illustrates another modified form of the present invention, indicated generally at 210, in which an annular elastomeric seal sleeve 247 is used to control the flow of fluids through the wall of a cementing collar. The cementing collar 210 illustrated in FIG. 4 carries reference characters that are higher by 200 than the reference characters used in FIGS. 1 and 2 to identify corresponding components.

The seal sleeve 247 is secured to a sleeve mount 244 anchored in place within a sliding sleeve support 230. A snap ring 245 extends between aligned annular recesses in the sleeve mount 244 and these support 230 to fix the two components axially relative to each other. An annular, elastomeric seal 245*a* in an annular recess in the sleeve mount 244 cooperates with the seal sleeve 247 to prevent flow of fluids from within the collar 210 through the radial ports 256 and 255.

When the pressure within the cementing collar 210 is greater than that existing outside of the cementing collar seal, in the area communicating with the radial openings 255 and 256, the seal sleeve 247 is pressure actuated to expand radially to prevent fluid flow from the cementing collar through the radial openings. When the pressure externally of the cementing collar is greater than that internally of the collar, the external pressure partially radially collapses the seal sleeve 247 permitting fluid to enter the cementing collar, as required, to automatically fill the casing. With the exception of the one-way valving action provided by the seal sleeve 247, the cementing collar 210, illustrated in FIG. 4, operates in a manner similar to that described with reference to the embodiment of the invention illustrated in FIGS. 1, 2 and 3.

While preferred forms of the invention have been described in detail herein, it will be appreciated that various modifications in the described methods and apparatuses may be made without departing from the spirit and scope of the invention, which is more fully defined in the following claims.

What is claimed is:

1. A cementing collar comprising:

first one-way flow valving comprising at least one flapper valve element for admitting fluid into the collar through an entry flow passage when the pressure of fluids external to the collar is greater than the pressure of fluids internal to the collar; and second one-way flow valving for allowing fluid to flow from the collar through an exit flow passage when the pressure of fluid inside the collar is greater than the pressure of fluid outside the collar.

2. A cementing collar as defined in claim 1, wherein said first one-way valving is carried by a movable support that is movable between first and second positions within said collar whereby at said first position said first one-way valving prevents exit fluid flow from said collar through said entry flow passage and at said second position said support prevents exit fluid flow from said collar through said entry flow passage.

3. A cementing collar as defined in claim 2, wherein said movable support is movable axially within said collar between said first and said second positions.

4. A cementing collar as defined in claim 2, wherein said movable support is temporarily secured to said collar at said first position by a frangible retainer.

5. A cementing collar as defined in claim 2, wherein said movable support comprises a tubular body carried coaxially within said collar.

6. A cementing collar as defined in claim 5, further comprising axially spaced, annular elastomeric seals carried intermediate said tubular body and said collar.

7. A cementing collar as defined in claim 2, further comprising axially spaced, annular elastomeric seals carried intermediate said tubular body and said collar.

8. A cementing collar as defined in claim 7, wherein said entry fluid flow passage comprises at least one radial opening extending through said collar.

9. A cementing collar as defined in claim 8, wherein said flapper closure element includes a semi-hemispheric surface adapted to engage and seal said entry flow passage to prevent exit fluid flow from said collar through said entry flow passage.

10. A cementing collar as defined in claim 9, wherein said movable support is movable axially within said collar between said first and said second positions.

11. A cementing collar as defined in claim 10, said movable support is temporarily secured to said collar at said first position by a shear pin.

12. A cementing collar as defined in claim 11, wherein said collar is connected within a casing string adjacent a float valve.

13. A cementing collar as defined in claim 11, wherein said float valve comprises said second one-way flow valving.

14. A cementing collar as defined in claim 13, wherein said second one-way flow valving comprises a spring-loaded check valve biasing a valve closure member toward a position resisting exit fluid flow from said exit flow passage.

15. A cementing collar as defined in claim 2, wherein:

said movable support is temporarily secured to said collar at said first position by a frangible retainer; and said second one-way flow valving comprises a spring-loaded check valve biasing a valve closure member toward a position resisting exit fluid flow from said exit flow passage.

16. A cementing collar as defined in claim 1, wherein said flapper closure element includes a semi-hemispheric surface adapted to engage and seal said entry flow passage to prevent exit fluid flow from said collar through said entry flow passage.

17. A cementing collar as defined in claim 1, wherein said flapper closure element includes a planar closure surface adapted to engage and seal said entry flow passage to prevent exit fluid flow from said collar through said entry flow passage.

18. A cementing collar as defined in claim 1, wherein said entry fluid flow passage comprises at least one radial opening extending through said collar.

19. A cementing collar as defined in claim 1, further comprising:

a substantially unrestricted flow passage through said collar between said first and second one-way flow valving for permitting forward circulation of fluid through said collar.

20. A method of cementing a casing string in a wellbore, comprising:

lowering a casing string equipped at its lower end with a cementing collar into a wellbore containing drilling fluids;

flowing drilling fluids from said wellbore into said casing string through a first one-way valve in said cementing collar, said first one-way valve permitting fluid flow in a direction from said wellbore into said cementing collar through an entry flow passage extending through said cementing collar and preventing fluid flow through said entry flow passage in a direction from said cementing collar into said wellbore; pumping drilling fluids from said casing string into said wellbore through an end of said casing while said entry flow passage is closed to fluid flow from said casing string to said wellbore; and thereafter, flowing drilling fluids from said wellbore into said casing string through said entry flow passage.

21. A method of cementing a casing string in a wellbore as defined in claim 20, further comprising, changing the position of said first one-way valve to prevent fluid flow into said casing string through said entry flow passage.

22. A method of cementing a casing string of a wellbore as defined in claim 21, further comprising, pumping a cement slurry through said casing string and into said wellbore after changing the position of said first one-way valve.

23. A method of cementing a casing string in a wellbore as defined in claim 21, further comprising, changing the position of said first one-way valve by shifting said first one-way valve axially through said cementing collar.

24. A method of cementing a casing string in a wellbore as defined in claim 20, further comprising, pumping a cement slurry through said casing string and into said wellbore.

25. A method of cementing a casing string in a wellbore as defined in claim 24, further comprising, changing the position of said first one-way valve to prevent fluid flow into said casing string through said entry flow passage.

26. A method of cementing a casing string in a wellbore as defined in claim 20, further comprising, pumping a first cementing plug through said casing string into engagement with said first one-way valve to change the position of said first one-way valve.

27. A method of cementing a casing string of a wellbore as defined in claim 26, further comprising, pumping a cement slurry through said casing string and into said wellbore after changing the position of said first one-way valve.

28. A method of cementing a casing string in a wellbore as defined in claim 27, further comprising, pumping a second cementing plug through said casing string behind said cement slurry for displacing said cement slurry from said casing string.

29. A self-fill cementing collar comprising:

a tubular collar body having a fill port extending through a wall of said body:

a tubular valve sleeve carried coaxially internally of said collar body, said tubular valve sleeve being movable axially between first and second axially spaced positions within said tubular collar body;

a flow passage extending through a wall of said valve sleeve for fluid communication with said fill port in said collar body when said tubular valve sleeve is at said first position;

a check valve carried by said valve sleeve for admitting or preventing flow of fluid between said fill port and said flow passage when said tubular valve sleeve is at said first position;

a temporary retainer for securing said tubular valve sleeve at said first position; and wherein said check valve comprises a flapper valve.

30. A self-fill cementing collar as defined in claim 29, wherein said temporary retainer comprises a frangible member securing said tubular valve sleeve to said tubular collar body.

31. A self-fill cementing collar as defined in claim 30, wherein said flapper valve comprises a hemispherical closure section adapted to seat in a cylindrical bore extending radially through a cylindrical wall.

32. A self-fill cementing collar as defined in claim 30, wherein said flapper valve comprises a planar closure section adapted to seat on a planar axial end of a cylindrical wall opening.

* * * * *